United States Patent [19]

Ueno et al.

[11] 4,082,038

[45] Apr. 4, 1978

[54] APPARATUS FOR AUTOMATICALLY REMOVING DUST FROM A FORM CYLINDER OF A PRINTING MACHINE

[75] Inventors: Tadayoshi Ueno, Koganei; Akio Itaya, Tokyo, both of Japan

[73] Assignees: Hitachi Printing Co. Ltd.; Nikka Kabushiki Kaisha, both of Tokyo, Japan

[21] Appl. No.: 784,688

[22] Filed: Apr. 5, 1977

[30] Foreign Application Priority Data

Apr. 7, 1976 Japan ..... 51-38187
Apr. 7, 1976 Japan ..... 51-41992

[51] Int. Cl.[2] ..... B41F 35/02
[52] U.S. Cl. ..... 101/425
[58] Field of Search ..... 101/423, 425, 148, 349, 101/350; 15/319, 236 R, 236 B, 256.51; 118/104; 318/593, 608

[56] References Cited

U.S. PATENT DOCUMENTS

| | | | |
|---|---|---|---|
| 3,128,699 | 4/1964 | Gegeneimer et al. | 101/364 |
| 3,144,826 | 8/1964 | Lang et al. | 101/425 |
| 3,252,416 | 5/1966 | Allen | 101/425 |
| 3,323,030 | 5/1967 | Inaba et al. | 318/593 |
| 3,581,180 | 5/1971 | Russell et al. | 318/608 |
| 3,822,642 | 7/1974 | Grindeland | 101/425 |

*Primary Examiner*—J. Reed Fisher
*Attorney, Agent, or Firm*—Fleit & Jacobson

[57] ABSTRACT

An apparatus for automatically removing dust from form cylinder of a printing machine. The apparatus has a body which is movable along the entire length of the form cylinder. The body has a tip member which is moved toward the surface of the form cylinder. The movements of the body and the tip member are remote-controlled.

9 Claims, 8 Drawing Figures

12
48
56
44
44a
52
62
58
60
54a
50
64
10a
40
10
76
46
54
70
72
66
42
68
A
8
8a
10c
74
80
50
2
10b
26
82
83
84
86

APPARATUS FOR AUTOMATICALLY REMOVING DUST FROM A FORM CYLINDER OF A PRINTING MACHINE

BRIEF SUMMARY OF THE INVENTION

The present invention relates to a novel apparatus for automatically removing dusts or the like which are adhered to a form cylinder of a printing machine, and more particularly to the such apparatus which is electrically and remotely controlled.

In an operation of a conventional printing apparatus, dusts which are floating in the air of a room fall onto, and stick to, a surface of a form cylinder of the printing apparatus. The "dusts" herein represent and include various kinds of dusts such as fine particles of paper materials, which are produced, for example, by a cutting operation, powder which is used for preventing objectionable reverse printing when piled after printed, and many other dusts floating in the air of the printing room. These dusts stick to the surface of the form cylinder of the printing apparatus have caused an obscure, unclear printing. Namely, when the dusts are stuck to the form cylinder, it has been experienced that the printed materials lacked clearness and that the desired printings did not come out well.

In such a case as described above, workmen or operators of the machine have manually swept the rotary surface of the form cylinder by using waste cotton whereas the machine is being operated continuously. Accordingly, there have been experienced a serious danger that a hand grasping the waste is accidentally caught by the rolling form cylinder and a rubber blanket cylinder.

In order to prevent the above-mentioned danger, an attempt has been made to use, in place of a human hand and waste cotton, a tool which is manually slidable along the entire length of the form cylinder. However, the known tool has not fully met with the requirements of removal of dusts.

Accordingly, an object of the present invention is to provide a novel apparatus for automatically removing the dusts from a form cylinder.

Another object of the present invention is to provide the apparatus which allows a reliable and safe operation of removing the dusts.

Further object of the present invention is to provide the apparatus which is controlled at a remote place.

Further object of the present invention is to provide the apparatus which allows a cleaning and an exchange of a dust removal element during the operation of the printing machine.

Additional objects and features of the present invention will become apparent from detailed description thereof, which will be read with reference to the accompanying drawings.

DESCRIPTION OF THE DRAWINGS

FIGS. 5, 6 and 7 are circuit diagram of a control device, in which FIG. 5 shows a form cylinder selection circuit, FIG. 6 shows a control circuit, and FIG. 7 shows a driving circuit.

DETAILED DESCRIPTION OF THE INVENTION

Figure 1:
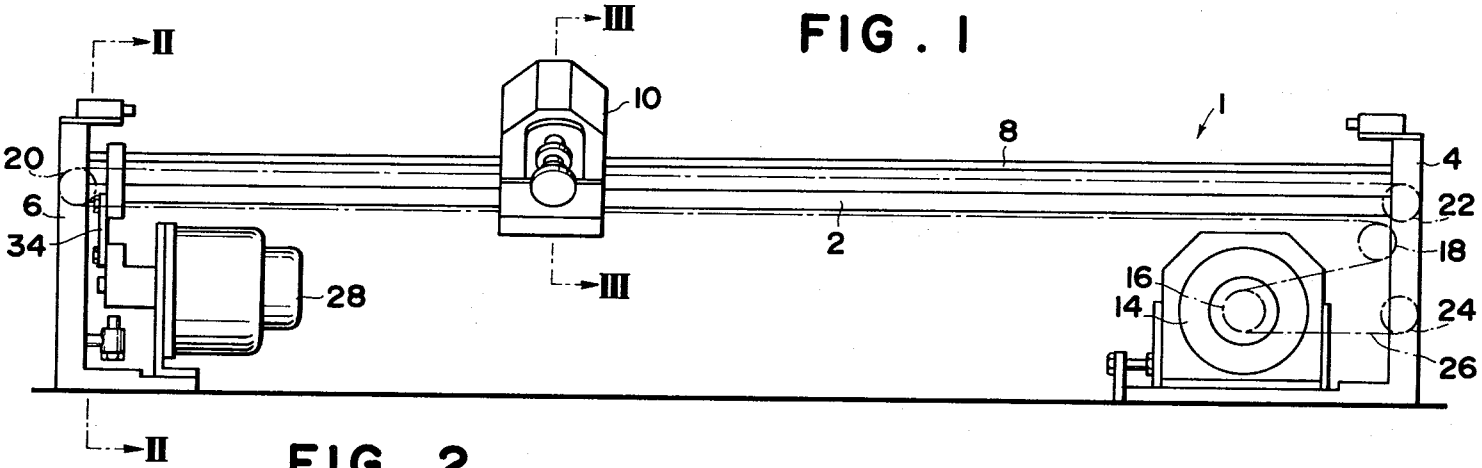
FIG. 1 is a front view of the apparatus embodying the present invention.
Figure 2:
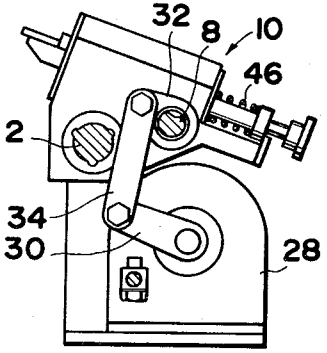
FIG. 2 is a side view taken along II—II of FIG. 1, which shows a dust removal device embodying the invention.
Figures 3, 8:
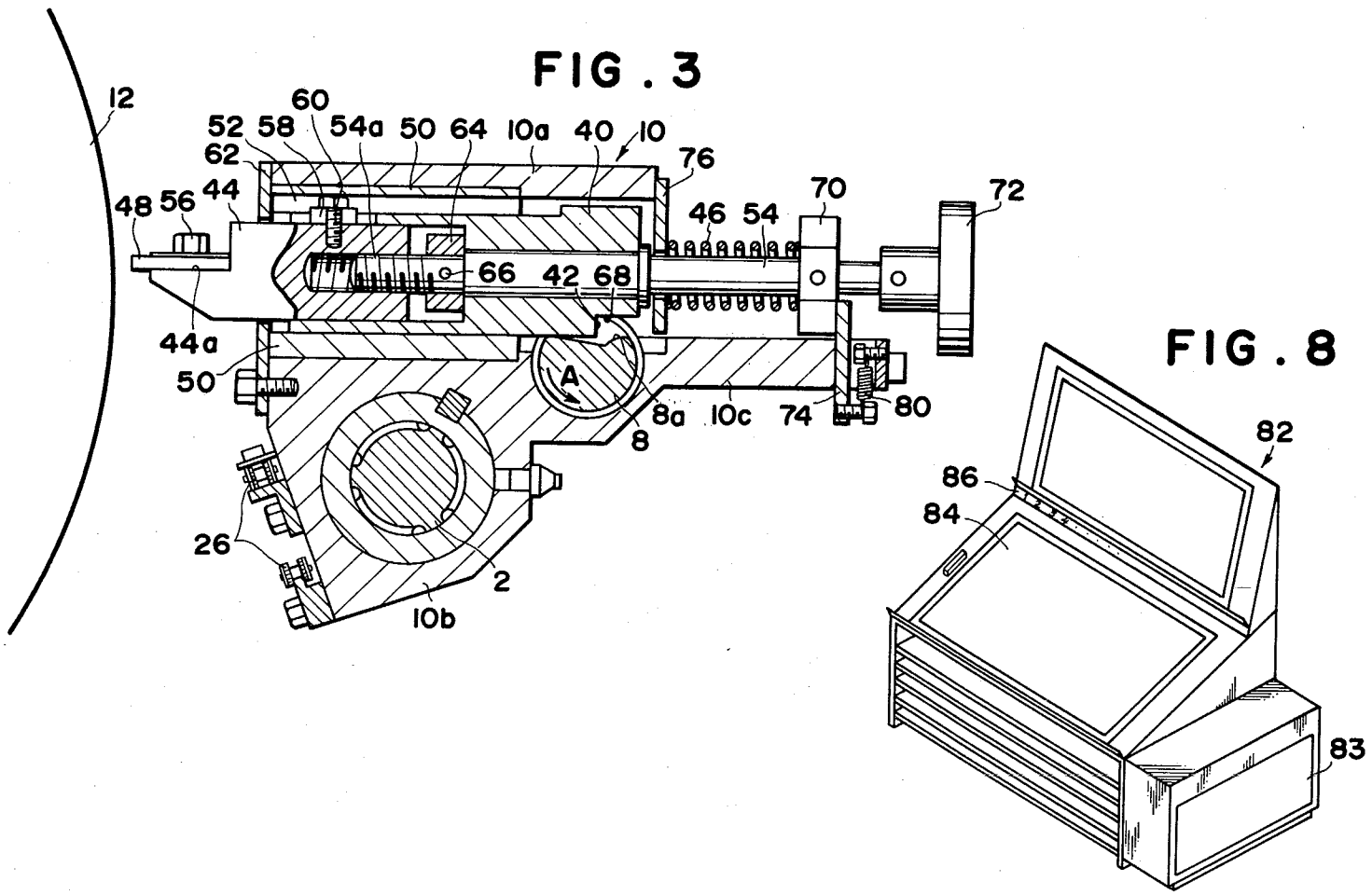
FIG. 3 is an enlarged sectioned view of the device shown in FIG. 2, taken along III—III of FIG. 1.
FIG. 8 is a perspective view of an inspection table.

Referring to FIGS. 1 through 4, in which like parts are designated by the same reference numerals throughout the various figures, an apparatus 1 has a guide rail 2 which is supported by brackets 4 and 6 adjacent to a form cylinder illustrated at 12 in FIG. 3, a shaft 8 rotatably supported by the brackets. The shaft and guide rail are disposed in parallel with an axis of the form cylinder. A movable body 10 is suspended or supported by the guide rail 2 in such a manner that the movable body 10 is slidable along the entire length of the guide rail 2, but not pivotable about the guide rail 2 as shown in FIG. 3. The guide rail 2 is disposed adjacent to, and along the rolling surface of, the form cylinder 12 of the printing machine, and the movable body 10 moves adjacent to, and along the entire length of the rolling surface of, the form cylinder to which dusts will be attached. Adjacent the bracket 4 is installed a motor 14 which is connected with a sprocket 16. Additional sprockets 18, 22 and 24 are provided on the side of the bracket 4, and another sprocket 20 on the side of the other bracket 6. The motor 14 and the sprocket 16 connected thereto are communicated mechanically with the sprockets 18, 20, 22 and 24, in turn, by means of an endless chain 26. The movable body 10 is fixed to the predetermined position of the endless chain 26. Thus, clockwise and counterclockwise rotation of the shaft (not shown) of the motor 14 allows the movable body 10 to run toward the predetermined position of the form cylinder 12 along the rolling surface of the form cylinder.

Adjacent the other bracket 6 is installed a rotary solenoid 28 which is connected to the end of the shaft 8 through levers 30 and 32 and link 34, as shown in FIG. 2. The shaft 8 is substantially round shaped in cross section but is cut out along the entire length thereof such that the shaft has a shoulder 8*a* along the entire length thereof, as well shown in FIG. 3. The shoulder 8*a* of the shaft 8 will abut against or contact with a shoulder portion 42 of a slidable sleeve, which is shown at 40 and will be described later in detail. The rotary solenoid 24 may be replaced by any other suitable devices if they have the similar functions as the rotary solenoid has.

The movable body 10 has an upper housing 10*a*, a lower base part 10*b* and an extended portion 10*c* which has a flat upper surface. In the housing 10*a*, a slidable sleeve 40 and a tip holder 44 are disposed. The sleeve 40 and the holder 44 are slided in the housing 10*a* by means of a spring 46. A tip member 48 is removably attached to the end of the holder 44, and when the sleeve 40 is forcibly pushed against the force of the spring 46, the tip member 48 contacts the surface of the form cylinder 12.

To be more specific, the slidable sleeve 40 and a bush member 50 are mounted within the housing 10*a* of the movable body 10 such that the sleeve 40 may be slided on the inner surface of the bush member 50. The bush member 50 has a groove 52 on its inner and upper surface along substantially entire length thereof. A shaft 54 is inserted into the sleeve 40 and tightly contacted thereto. The shaft 54 is extended and has a spiral groove 54*a* at the extended portion which is threadedly engaged with a spiral groove formed within the one end portion of the tip holder 44. The holder 44 has a recessed flat portion 44*a* at the other end on which a tip 48 is removably fixed by a screw 56. The tip 48 may be made of any desired material, and preferably be made of resilient material such as rubber or synthetic resins. Thus, the sleeve 40 as well as the tip holder 44 and the shaft 54 are connected with one another such that these three elements 40, 44, 54 may be slided back and forth in the lengthwise directions of the shaft 54. The tip holder 44 has at its upper portion a block 58 which is fixed by a screw 60 and slidably fit within the aforementioned groove 52 of the bush member 50. The block 58 allows a longitudinal movement of the sleeve 40, the tip holder 44 and the shaft 54 but prevents a rotational movement of these elements 40, 44 and 54. In FIG. 3, reference numeral 62 represents a plate which prevents the bush member 50 from sliding out of the housing 10*a* of the movable body 10, and reference numeral 64 represents a thrust collar which is fixed on the predetermined position of the shaft 54 by a pin 66.

The slidable sleeve 40 has a recess 68 to form the aforementioned shoulder 42 at the lower end portion thereof and above the shaft 8 such that the shoulder 8*a* of the shaft 8 may thrust the shoulder 42 of the sleeve 40 to press the sleeve 40 toward the form cylinder 12. At the rear end of the shaft 54, there are disposed a stopper 70 and a knob 72. The stopper 70 has a polygonal outer shape, which is octagonal in the embodiment of FIG. 4, in order to prevent an accidental rotation of the shaft 54 due to vibrations of the printing machine. One side of the polygonal stopper is slightly contacted with the flat surface of the extended portion 10*c* of the movable body 10. A stopper plate 74 is fixed to the movable body 10 to prevent the stopper 70 from further moving rearward. Between the stopper 70 and a plate 76, the latter being removably contacted with the rear end of the upper housing 10*a* of the movable body 10, the aforementioned spring 46 is disposed around the rear portion of the shaft 54, thereby urging the combined structure of the sleeve 40, the tip holder 44 and the shaft 54 to move toward the right hand side of FIG. 3.

Figure 4:
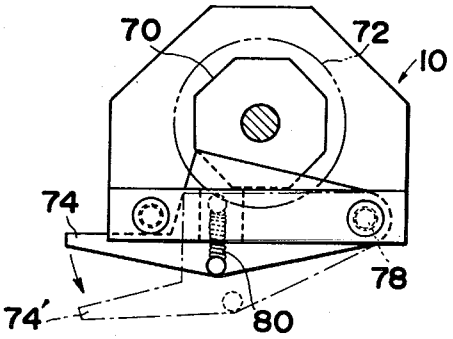
FIG. 4 is a side view of the device shown in FIG. 3.

The stopper plate 74 is, as shown in FIG. 4, pivotably connected at its one end to the movable body 10 by means of a pin 78, but usually supported in position by a spring 80. Thus, when the stopper plate 74 is pivoted against the force of the spring 80 about the pin in the direction shown by an arrow of FIG. 4 to the position 74' illustrated by phantom lines, the shaft 54, the sleeve 40 and the tip holder 44 will be released from the housing 10*a* of the movable body 10 by pulling the knob 72.

Thus, the rotational driving of the shaft 8 in the direction shown by an arrow A of FIG. 3 enforces the combined structure, that is, the elements 40, 44 and 54, to move toward the form cylinder 12. If needed, the position of the tip 48 may be adjusted by rotating the knob 72. When the knob 72 is rotated in the clockwise or counter-clockwise direction, the slidable tip holder 44, which is unrotatable and threadedly engaged with the shaft 54, moves toward or away from the form cylinder 12.

Though the apparatus of the present invention has been described with reference to a single form cylinder, desired number of the apparatus are installed when multicolor printing is required which needs a plurality of form cylinders. In the multicolor printing the apparatus described above is installed for each of the form cylinders.

Figure 5:
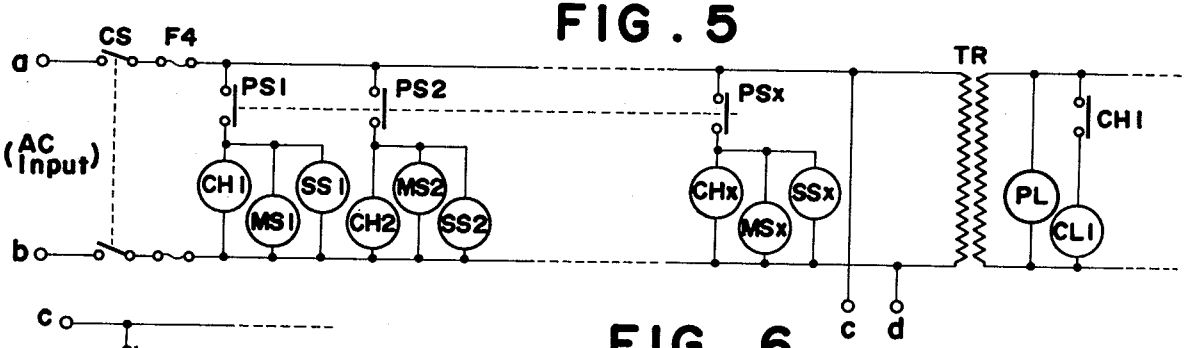
Figure 6:
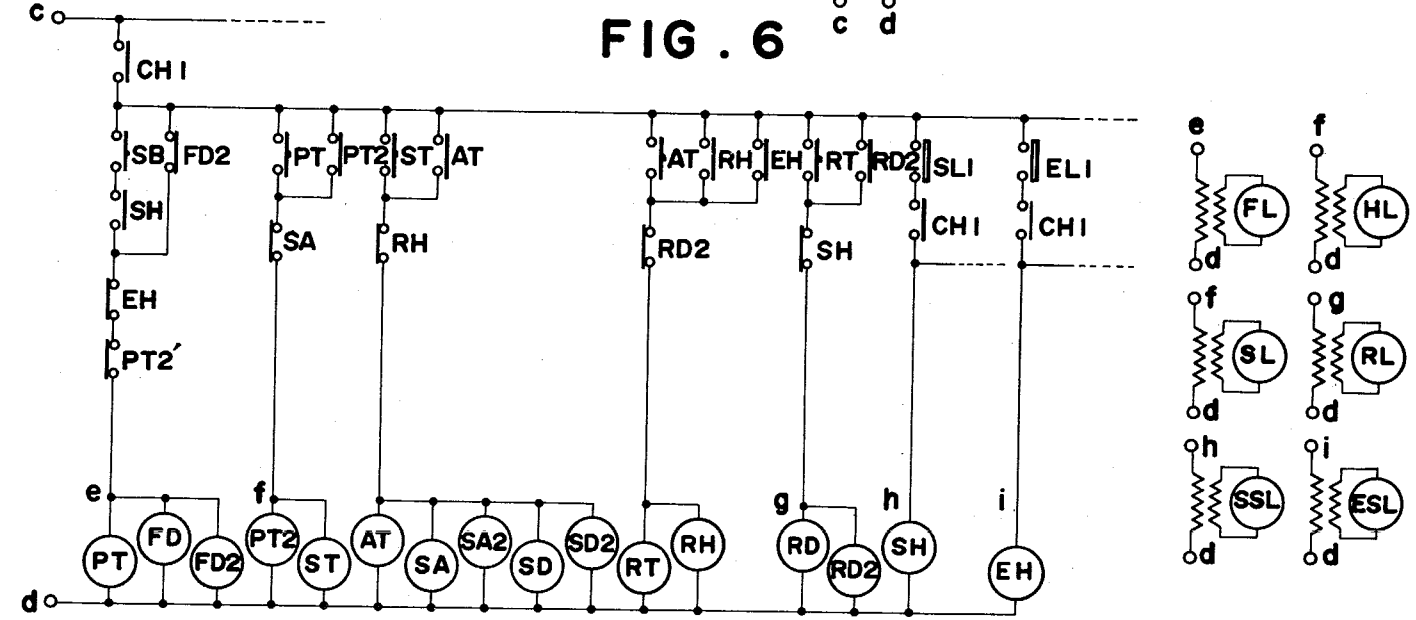
Figure 7:
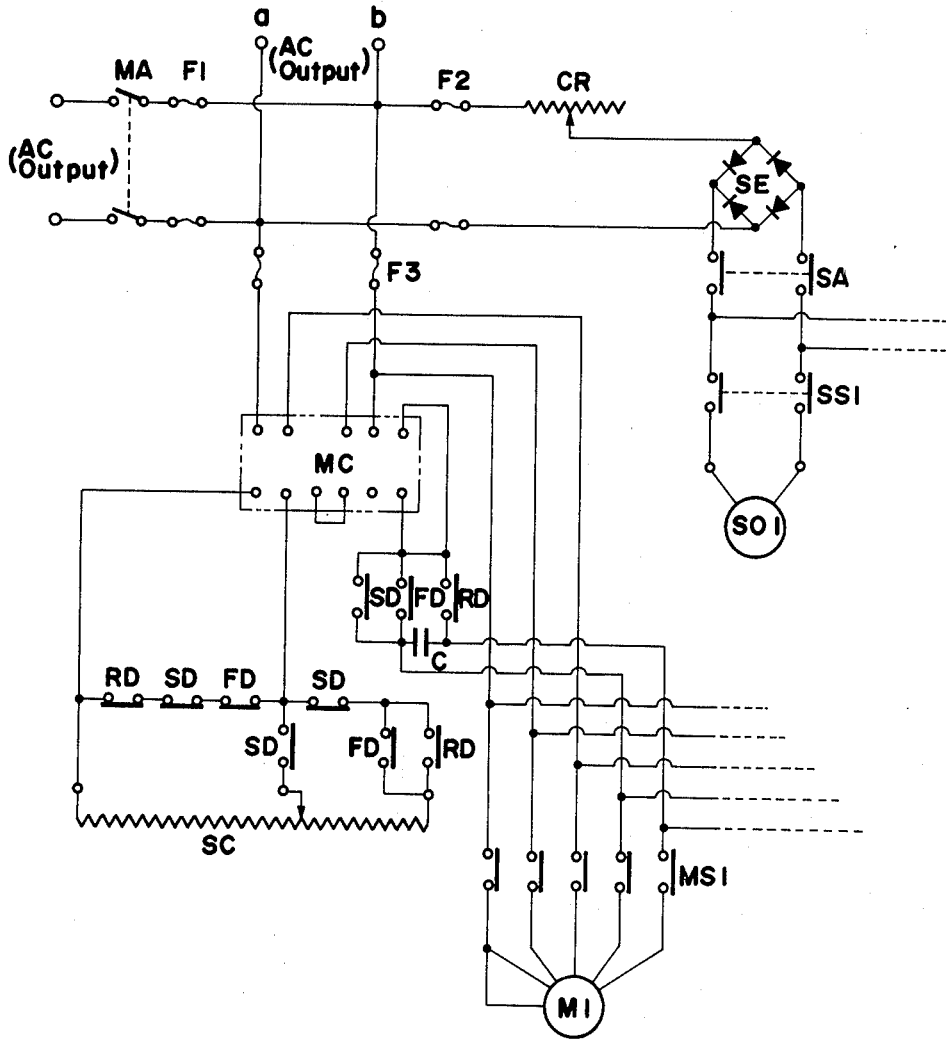

The motor 14 and the rotary solenoid 28, which are illustrated in FIG. 1, are driven and controlled by means of electrical circuits shown in FIGS. 5 to 7. An operation will be described with reference to FIGS. 5 to 8. FIGS. 5 to 7 are circuits applied for a multicolor printing which is achieved by a plurality of the invented apparatus which are attached to a plurality of form cylinders of the printing machine.

In the first place, a main power source switch MA (FIG. 7) and a power supply switch CS for an operating circuit (FIG. 5) are switched on, and then the predetermined one or more form cylinder selecting switches $PS_1$ through $PS_x$ is switched on to operate desired electrical relays among form cylinder selection relays $CH_1$ through $CH_x$, motor selection relays $MS_1$ through $MS_x$ and rotary solenoid selection relays $SS_1$ through $SS_x$.

In connection with the form cylinder selection, it is achieved by watching a sample of printed product on an inspection table which is shown by reference numeral 82 in FIG. 8. Namely, a printed sample 84 (FIG. 8) is placed on the inspection table 82, which has indicia 86 along the side of the table 82 as illustrated in FIG. 8, to watch an unclear printing position due to a dust fixed to the form cylinder. If the unclear printing due to the dust is found, the form cylinder to which the dust is fixed is selected among the plurality of form cylinders for multicolor printing.

Accordingly, when one of the form cylinder, for example, a form cylinder numbered "1", is selected, a contact of the relay $CH_1$ is closed and a form cylinder selection lamp $CL_1$ is lighted. At the same time, a contact $MS_1$ of the relay $MS_1$ is closed to prepare for driving of a motor $M_1$, the motor $M_1$ being shown by reference numeral 14 in FIG. 1, and contacts $SS_1$ of a relay $SS_1$ are closed to prepare for a movement of the tip 48 (FIG. 3).

A position where the dust is placed is given by the indicia 86 of the inspection table 82 and then a dust removal position setting timer PT (FIG. 6) is arranged and checked with the predetermined indicium. In this embodiment, at the time when the main switch MA is put on, the movable body 10 (FIG. 1) is positioned at the right extremity and a limit switch $SL_1$ is put on to contact with a supplemental relay SH to light a starting position indication lamp SSL. Thus, required preparation for the operation is finished.

After the aforesaid preparation is completed, a starting button switch for automatic operation is pushed to light a motor driving indication lamp FL. Simultaneously, the position setting timer PT, a motor driving relay FD and a motor driving supplemental relay $FD_2$ are energized. The FD contacts (FIG. 7) of the selected motor $M_1$ are closed to drive the motor $M_1$ at a high speed. Thus, the movable body 10 is delivered at a high speed to the predetermined position by means of the chain 26 of FIG. 1.

When the time which is set by the dust removal position setting timer PT comes round, the PT contact is closed by the output of the timer to energize a supplemental relay $PT_2$ and a reduction-delay time ST. At this time, the contact $PT_2'$ of the relay $PT_2$ is opened to thereby cut off the dust removal position setting timer PT, the motor driving relay FD and the supplemental relay $FD_2$.

After the predetermined time delay, a timer AT which sets the time for pressing the movable body toward the form cylinder 12, rotary solenoid relays SA and $SA_2$, motor driving relays SD and $SD_2$ are energized whereas the selected rotary solenoid $SO_1$ is activated to press the tip 48 (FIG. 3) onto the surface of the form cylinder 12, and at the same time to move the movable body at a lower speed to the predetermined position for the time which is set by the timer AT. In other words, the movable body 10 moves at a high speed to a place adjacent to the position where the dust is attached in the first place, and then the tip 48 is pushed onto the rolling surface of the form cylinder while the movable body 10 is moved slowly and further. In this instance, a lamp HL is lighted to indicate that the rotary solenoid is in operation whereas a lamp SL is lighted to indicate that a dust removal is being carried out by the movable body 10.

After the dusts are removed, another timer RT which sets the time for reversal movement, a supplemental relay RH are energized to open a contact of the supplemental relay RH, thereby cutting out the aforementioned time setting timer AT, the rotary solenoid driving relays SA and $SA_2$, the low speed driving relays SD and $SD_2$ for the motor $M_1$. At the same time, a reversal movement lamp RL is lighted, and the rotation of the motor $M_1$ is reversed to move the tip 48 in the opposite direction. When the tip 48 of the movable body is retreated as described above, a limit switch $SL_1$ is actuated to energized the relay SH and to light the starting position indication lamp SSL is lighted. Thus, the contact of the relay SH is opened and a high speed reversal driving relays RD and $RD_2$ of the motor $M_1$ is cut out to finish the dust removal operation.

In FIGS. 5, 6 and 7, symbols $F_1$, $F_2$, $F_3$ and $F_4$ represent fuse elements, symbol C a starting capacitor for the motor, symbol SC a variable resistance for controlling the rotating speed of the motor, symbol CR a variable resistance for an adjustment of the pressing force of the movable body toward the form cylinder, and symbol SE a rectifier. In FIGS. 5 and 6, symbols TR, PL, ESL and EH represent, respectively, a transformer for indication lamps, a power source indication lamp, ending position indication lamp and a relay of an ending position limit switch.

The aforementioned electrical circuits and control switches are disposed in a control box 83 shown in FIG. 8 to permit an automatic remote control of the dust removal operation by simply operating the switch buttons while watching the printed sample on the inspection table of FIG. 8.

Though the present invention has been described in which the movable body is retreated to the starting position for the following dust removal operations, additional device may be provided so that the movable body 10 may stand still at the place where the preceding dust removal operation is conducted, and wait for the following dust removal operation. In this case, the additional device is the one which senses the distance between the position of the removable body and the position of another dust which should be removed in the following operation.

Although the present invention has been described with reference to a preferred embodiment thereof, many modifications and alterations may be made within the spirit of the present invention.

What we claim is:

1. An apparatus for automatically removing dusts from form-cylinder of a printing machine, comprising:

brackets adjacent to the ends of said form-cylinder;

a guide member connected with said brackets;

a movable body slidably contacted with said guide member such that the former is slidable substantially along the entire length of the latter, said movable body having slidable structure which has a tip member at the end thereof and is slidable toward the rolling surface of said form cylinder, a base portion, an extended portion having a flat upper surface, a housing in which said slidable structure is positioned, a bush member confined between said housing and said slidable structure, said slidable structure having a tip holder, a sleeve member and a first shaft, said first shaft having a stopper member at the end thereof and being inserted through said sleeve member, and a spring confined between said housing and said stopper member;

means for moving said slidable structure toward the rolling surface of said form cylinder, having a second shaft which is rotatably connected with said brackets and has a shoulder along substantially the entire length thereof and a device for rotating said second shaft in the clockwise and counter-clockwise directions at predetermined angles, whereby when said second shaft is rotated at the predetermined angles, said shoulder presses said slidable structure toward the form cylinder;

means for moving said movable body along said guide member;

a first electrical device which controls the movement of said movable body along said guide member; and a second electrical device which controls the movement of said slidable structure.

2. The apparatus according to claim 1, in which said bush member has a groove along the substantially entire length thereof, said tip holder having a block which is slidably fit within said groove, thereby preventing a rotational movement of said tip holder.

3. The apparatus according to claim 1, in which said first shaft has a spiral groove at the end portion thereof, said tip holder having a hollow on which a spiral groove is formed.

4. The apparatus according to claim 1, in which said sleeve member has a recess having a shoulder at the lower end thereof, a hole being formed at the base portion of said movable body substantially below the said recess, said second shaft being inserted through said hole, whereby when said second shaft is rotated, said shoulder of said second shaft is contacted with said shoulder of said sleeve member to move the slidable structure against the force of said spring.

5. The apparatus according to claim 1, in which the side plate of said housing against which one end of said spring is anchored is removably contacted with said housing, said apparatus further comprising a plate member which is contacted with said stopper member, said plate member being pivotably connected with the extended portion of said movable body, and a spring which is connected at its one end with said extended portion and connected at the other end with said plate member, whereby when said plate member is pivoted downwardly against the force of said spring, the contact of said stopper member with said plate member is released to thereby allow the combined slidable structure to be released from the housing of said movable body.

6. The apparatus according to claim 1, in which said tip member is made of synthetic resin material and is removably connected with said slidable structure.

7. The apparatus according to claim 1, in which said device for rotating said second shaft has a rotary solenoid and a link structure connecting the rotary solenoid to the end of said second shaft.

8. The apparatus according to claim 1, in which said means for moving said movable body has a motor, sprockets and an endless chain, said movable body being fixed to said chain.

9. The apparatus according to claim 1, in which said first shaft is firmly contacted at its substantially middle portion with said sleeve and threadedly engaged with said tip holder.

* * * * *